United States Patent [19]

Fechter

[11] 4,223,834

[45] Sep. 23, 1980

[54] RAIL CONNECTION FOR ELECTRICAL TOY MODEL RAILROADS

[75] Inventor: Willi Fechter, Nuremberg, Fed. Rep. of Germany

[73] Assignee: Gebr. Fleischmann K.G., Nuremberg, Fed. Rep. of Germany

[21] Appl. No.: 3,454

[22] Filed: Jan. 15, 1979

[30] Foreign Application Priority Data

Jan. 20, 1978 [DE] Fed. Rep. of Germany ..... 7801529

[51] Int. Cl.[3] ..... E01B 23/04

[52] U.S. Cl. ..... 238/10 E; 46/1 K

[58] Field of Search ..... 238/10 R–10 F; 46/1 K, 216

[56] References Cited

U.S. PATENT DOCUMENTS

| | | | |
|---|---|---|---|
| 2,428,468 | 10/1947 | Pinder | 238/10E |
| 2,711,857 | 6/1955 | Vanetzian et al. | 238/10 E |
| 3,074,647 | 1/1963 | Bonanno | 238/10 E |
| 3,734,404 | 5/1973 | Baynes et al. | 238/10 E |

FOREIGN PATENT DOCUMENTS

| | | | |
|---|---|---|---|
| 1169824 | 5/1964 | Fed. Rep. of Germany | 238/10 E |
| 2220177 | 11/1973 | Fed. Rep. of Germany | 238/10 E |
| 1255076 | 1/1961 | France | 238/10 E |
| 603814 | 6/1948 | United Kingdom | 238/10 B |

*Primary Examiner*—John J. Love
*Assistant Examiner*—Ross Weaver
*Attorney, Agent, or Firm*—Jordan and Hamburg

[57] ABSTRACT

A rail connection for connecting track assemblies of a toy model railroad, includes connecting clamp members extending between aligned rails of two juxtaposed track assemblies, the clamp members having an elongated base portion and generally U-shaped clamp parts having spaced legs extending upwardly from the base portion, the U-shaped clamp parts clampingly engaging the rails of the track assemblies to thereby connect the track assemblies.

10 Claims, 4 Drawing Figures

RAIL CONNECTION FOR ELECTRICAL TOY MODEL RAILROADS

BACKGROUND OF THE INVENTION

This invention relates to a rail connection for electrical toy model railroads and more particularly to a rail connection which utilizes connecting clamps bridging over the connecting part of two adjoining rails, the clamps being clampingly assembled onto the rails from below.

In the rail connection of this invention, the assembly of the individual rails is not actuated, as heretofore, by an inserting motion parallel to the axis of the rails, but rather by a motion that is vertical to that axis. The advantage of this arrangement, among other advantages, is that a rail section may be removed from an existing assembly by simply lifting it upwards without moving the adjacent rail section, in other words, without involving the whole assembly. By this arrangement repairs as well as alterations of an already existing assembly may be performed substantially simpler and without damaging or disturbing other parts of the assembly.

An example of a prior art connection is discribed in German Offenlegungsschrift 1 904 017. However, this prior art arrangement is not suitable for practical applications. Firstly, it is too expensive to manufacture, considering the needed tolerances, particularly when considering the small dimensions utilized in miniature model railroad arrangements. Furthermore the width of the openings needed for pressing onto the broad rail bases are too large so that the frequent use of the clamps would lead to damaging and bending.

SUMMARY OF THE INVENTION

Accordingly, an object of the present invention is to provide a rail connection with its insertion direction vertical to the axis or plane of the rails, which is simple in its manufacture as well as in its use, but which still is sufficiently robust so that it functions free of troubles even after frequent use. In order to attain this objective, a rail connection of the above described kind is furnished with a substantially U-shaped sheet metal part. This part consists of a connecting clamp with two or several tongue pairs surrounding the rail base in the area of a gap separating the rails and also behind the end ties. In a particularly advantageous embodiment the rail base is provided with recesses in such a manner in the area of the rail base that the breadth of the rail base is only slightly larger than the thickness of the rail neck.

This construction according to the invention ensures that the spring-like widening of the tongue pairs, when applying the clamp, is relatively small so that the aforedescribed difficulties in the application of known prior art rail connections with sharply bent clamping tongues are prevented. According to the present invention, a connection using the aforementioned vertical direction of connection does not need to almost completely surround the rail base because there is no necessity to fear a motion of the rails in the direction of loosening, in other words against the weight of the rail and the train. Even when the connecting clamps do not abut the underside the danger of sliding off is minimal, in other words the clamping force of the clamping tongues touching the rail even suffices to fasten the connecting clamps to the rails.

Furthermore, the present invention provides the advantage that the clamping tongues, while disposed over the recesses of the rail bases, not only center the rails immediately in the area of abutment but also secure the rails against pulling apart, in other words the rails cannot be separated when a pull along the rails occurs.

The rail connection according to the invention may be loosened simply by bending two tails or tracks around the disconnecting point upwardly or downwardly and thereby levering the spring clamp out of their clamping position. This can be done instead of vertically lifting the rail or track with the ties that connect them. In a further embodiment of the invention this manner of disconnection can be actuated very simply and advantageously when the connecting clamps are elongated on both ends further than the three clamping tongue pairs, and when in addition, the edges of the clamping tongue pairs and the extension sections are rounded off. This rounding off allows the ties or rail heads to slide or roll on these rounded-off edges when the tracks are bent. The clamping tongue pairs are provided with curved portions in the area of their free ends.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

DESCRIPTION OF THE PREFERRED EMBODIMENTS

Figure 1:
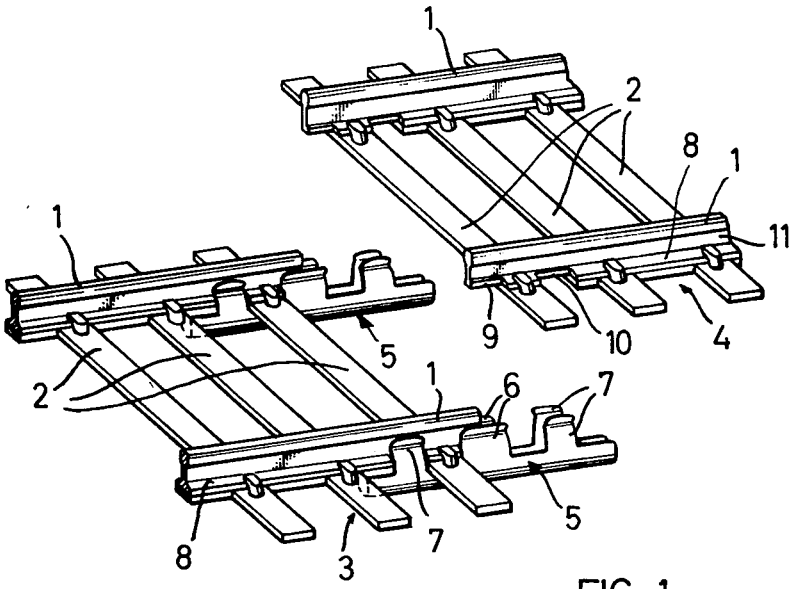
FIG. 1 is an exploded perspective view of the area of connection of two tracks.

Referring to the drawings there are shown two tracks 3 and 4 each consisting of two rails 1 and connecting ties 2. In order to connect the two tracks 3 and 4 connecting clamps 5 are provided. The connecting clamps 5 are substantially U-shaped sheet metal parts having clamping tongue pairs 6 and 7 spaced from one another. The connecting clamps 5 are pressed from underneath onto the rails 1 of the tracks are pushed from above into position between the clamping tongue pairs 6 and 7.

The rails 1 each have a rail base 8 and a rail neck 11. In the area of clamping tongue pairs 6 and 7, the rails base 8 is provided with recesses 9 and 10 in such a manner that the rail base in this area is only slightly broader than the rail neck 11. This forces the spring-like clamping tongue pairs 6,7 only slightly apart when the connecting clamps 5 are applied, a characteristic which, as previously mentioned in detail, assures simple application and long life of the clamps without resulting in any disadvantages as far as the quality of connection is concerned. Furthermore, the recesses 9 and 10 assure the longitudinal fastening of the rail connection, in other words, the rails cannot be separated by pulling longitudinally.

Figure 3:
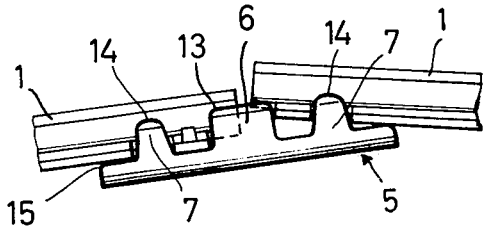
FIGS. 3 and 4 are side views of the tracks shown in FIG. 1 but showing how the connection may be loosened simply by bending the tracks downwardly or upwardly.
Figure 2:
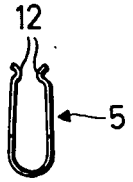
FIG. 2 is a cross sectional view of a connecing clamp.
Figure 4:
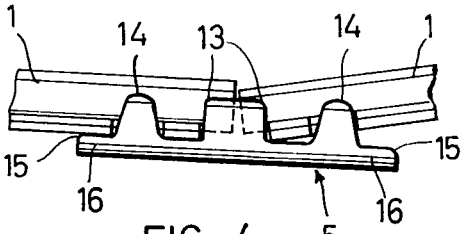

The clamping tongue pairs 6 and 7 are provided with curved portions 12 serving for the immediate side-gripping of the rail base 8. According to the length of the clamping tongue pairs 6,7, they may cause abutting of the clamping tongue pairs to the rail neck 11 in the area of the curved portions 12. The edges 13 and 14 of the clamping tongue pairs 6 and 7 are rounded of as well as the edges 15 of the extension segments 16 of the connecting clamps which protrude beyond the outer clamping tongue pairs 7. These extension segments 16 protrude in the embodiment shown underneath the ties vicinal to the end-ties so that when the track is bent downwardly (FIG. 3) these ties "roll" downwardly over these curvatures, similar to the process when conversely the rail heads roll off when the assembly is bent in order to disassemble the rail connection (FIG. 4).

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A rail connection for connecting track assemblies of a toy model railroad, said track assemblies having a pair of spaced rails mounted on spaced ties, the rail connection comprising connecting clamp members extending between aligned rails of two juxtaposed track assemblies, said clamp members having an elongated base portion and a plurality of spaced generally U-shaped clamp parts extending upwardly from said base portion, said elongated base portion being disposed to underlie the longitudinal end portions of juxtaposed and axially aligned rails and to underlie at least the end tie of each track assembly to be connected, said U-shaped clamp parts each having spaced legs extending upwardly from said base portion into the space between the ties of the rails to clampingly engage the rails of said track assemblies between said spaced ties, said connecting clamp members being assembled on and disassembled from the track assemblies from beneath said track assemblies.

2. A rail connection according to claim 1 wherein each rail has a base flange and an upright neck support, said base flange having recesses to accommodate said U-shaped clamp parts.

3. A rail connection according to claim 2 wherein the width of the base flange of the rail at said recesses is just slightly wider than said upright neck support.

4. A rail connection according to claim 1 wherein said elongated base portion has longitudinal ends extending longitudinally beyond said U-shaped clamp parts.

5. A rail connection according to claim 4 wherein the upper end portions of said longitudinal ends have an arcuate configuration.

6. A rail connection according to claim 1 wherein the upper terminating ends of said spaced legs of said U-shaped clamp parts have an arcuate configuration.

7. A rail connection according to claim 1 wherein three spaced U-shaped clamp parts are provided on said elongated base portion, the center U-shaped clamp part engaging the longitudinal end portions of two aligned and juxtaposed rails, the two outer U-shaped clamp parts engaging the respective rail between spaced ties, whereby said outer U-shaped clamp parts prevent longitudinal separation of the two connected rails.

8. A rail connection according to claim 7 wherein the width of said center U-shaped clamp part is greater than the width of the other U-shaped clamp parts.

9. A rail connection according to claim 1 wherein said U-shaped clamp parts are made of sheet metal and have opposed indentations adjacent their terminating ends.

10. A rail connection for connecting track assemblies of a toy model railroad, said track assemblies having a pair of spaced rails mounted on spaced ties, said rails each having a base flange and an upright neck support, the rail connection comprising connecting clamp members extending between aligned rails of two juxtaposed track assemblies, said clamp members having an elongated base portion and a plurality of spaced generally U-shaped clamp parts extending upwardly from said base portion, said elongated base portion being disposed to underlie the longitudinal end portions of juxtaposed and axially aligned rails and to underlie at least the end tie of each track assembly to be connected, at least two of said U-shaped clamp parts each having spaced legs extending upwardly from said base portion into the space between the ties of the rails to clampingly engage the rails of said track assemblies between said spaced ties, said base flange of said rails having recesses located between at least a pair of spaced ties, said legs being accommodated in said recesses to thereby preclude relative axial movement and prevent longitudinal separation of the two connected rails, and at least one other of said U-shaped parts extending upwardly from said base portion to engage the two longitudinal end portions of two juxtaposed and axially aligned rails, said connecting clamp members being assembled on and disassembled from the track assemblies from beneath said track assemblies.

* * * * *